US006645090B2

(12) United States Patent
Ohama et al.

(10) Patent No.: US 6,645,090 B2
(45) Date of Patent: Nov. 11, 2003

(54) MULTI-PIECE SOLID GOLF BALL

(75) Inventors: Keiji Ohama, Kobe (JP); Seiichiro Endo, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/972,869

(22) Filed: Oct. 10, 2001

(65) Prior Publication Data

US 2002/0065151 A1 May 30, 2002

(30) Foreign Application Priority Data

Oct. 10, 2000 (JP) ..... 2000-309128

(51) Int. Cl.[7] ..... A63B 37/04; A63B 37/06; A63B 37/00

(52) U.S. Cl. ..... 473/371; 473/351

(58) Field of Search ..... 483/351–378

(56) References Cited

U.S. PATENT DOCUMENTS

| | | | | | |
|---|---|---|---|---|---|
| 4,781,383 | A | * | 11/1988 | Kamada et al. | 473/373 |
| 4,813,677 | A | * | 3/1989 | Oka et al. | 473/384 |
| 5,002,281 | A | * | 3/1991 | Nakahara et al. | 473/373 |
| 5,439,227 | A | | 8/1995 | Egashira et al. | |
| 5,556,098 | A | | 9/1996 | Higuchi et al. | |
| 5,704,854 | A | | 1/1998 | Higuchi et al. | |
| 5,711,723 | A | * | 1/1998 | Hiraoka et al. | 473/374 |
| 5,782,707 | A | * | 7/1998 | Yamagishi et al. | 473/373 |
| 5,820,487 | A | * | 10/1998 | Nakamura et al. | 473/373 |
| 5,830,085 | A | | 11/1998 | Higuchi et al. | |
| 5,967,908 | A | | 10/1999 | Yamagishi et al. | |
| 6,042,488 | A | | 3/2000 | Sullivan et al. | |
| 6,045,459 | A | * | 4/2000 | Sugimoto et al. | 473/354 |
| 6,190,269 | B1 | * | 2/2001 | Moriyama | 473/373 |
| 6,319,155 | B1 | * | 11/2001 | Moriyama et al. | 473/371 |
| 6,336,872 | B1 | * | 1/2002 | Moriyama et al. | 473/374 |
| 6,379,268 | B1 | * | 4/2002 | Yamagishi et al. | 473/371 |
| 6,390,935 | B1 | * | 5/2002 | Sugimoto | 473/373 |
| 6,390,936 | B1 | * | 5/2002 | Sugimoto | 473/373 |

FOREIGN PATENT DOCUMENTS

| | | |
|---|---|---|
| EP | A1 0 908 199 | 4/1999 |
| JP | 2570587 | 10/1996 |
| JP | 8-332247 | 12/1996 |
| JP | 9-10357 | 1/1997 |
| JP | 9-10358 | 1/1997 |
| JP | 2658811 | 6/1997 |
| JP | 9-313643 | 12/1997 |
| JP | 10-305114 | 11/1998 |
| JP | 11-114094 | 4/1999 |

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

The present invention provides a multi-piece solid golf ball having good shot feel, excellent durability and excellent flight performance. The present invention relates to a multi-piece solid golf ball comprising a core having at least one layer, an inner cover formed on the core and an outer cover formed on the inner cover, of which the outer cover has many dimples on the surface thereof, wherein a surface hardness in JIS-C hardness of the core is higher than a center hardness in JIS-C hardness of the core by less than 5, the inner cover has a hardness in Shore D hardness of less than 53 and the hardness of the inner cover is higher than the surface hardness of the core, and a hardness of the outer cover is higher than that of the inner cover.

16 Claims, 1 Drawing Sheet

MULTI-PIECE SOLID GOLF BALL

FIELD OF THE INVENTION

The present invention relates to a multi-piece solid golf ball. More particularly, it relates to a multi-piece solid golf ball having good shot feel, excellent durability and excellent flight performance.

BACKGROUND OF THE INVENTION

In commercially available golf balls, there are solid golf balls such as two-piece golf balls, three-piece golf balls and the like, and thread wound golf balls. Recently, the two-piece golf ball and three-piece golf ball having improved flight distance over conventional thread wound balls while maintaining soft and good shot feel at the time of hitting as good as the conventional thread wound golf ball, generally occupy the greater part of the golf ball market. Multi-piece golf balls represented by the three-piece golf ball have good shot feel while maintaining excellent flight performance, because they can vary the hardness distribution, when compared with the two-piece golf ball.

The multi-piece solid golf balls are obtained by inserting an intermediate layer between the core and the cover layer constituting the two-piece solid golf ball and have been described in Japanese Patent Kokai Publication Nos. 332247/1996, 10357/1997, 10358/1997, 313643/1997, 305114/1998, 114094/1999 and Japanese Patent Nos. 2570587 and 2658811. In the golf balls, it has been attempted to compromise the balance of flight performance and shot feel at the time of hitting by using thermoplastic resin, such as thermoplastic elastomer (for example, polyurethane-based thermoplastic elastomer), ionomer resin or mixtures thereof, for the intermediate layer, to adjust a hardness, hardness distribution, deformation amount, specific gravity, elastic modulus and the like of the core, inner cover (intermediate layer) and cover to proper ranges.

In Japanese Patent Kokai Publication No. 332247/1996, a three-piece solid golf ball which comprises a two-layer structured core composed of an inner core and outer core, and a cover is described. The inner core has a diameter of 25 to 37 mm and a center hardness in JIS-C hardness of 60 to 85, a hardness difference from the center point to the surface of the inner core is not more than 4, the outer core has a surface hardness in JIS-C hardness of 75 to 90, and the cover has a flexural modulus of 1,200 to 3,600 kg/cm$^2$. In the golf ball, the inner core (intermediate layer) is formed from rubber composition, and durability is not sufficiently obtained.

In Japanese Patent Kokai Publication No. 10357/1997, a golf ball which comprises a core, and a two-layer structured cover composed of an inner cover and outer cover, is described. The inner cover is formed from ionomer resin and has a Shore D hardness of not more than about 65, the outer cover is formed from ionomer resin and has a Shore D hardness of at least about 60, which is higher than that of the inner cover, and the total thickness of the inner cover and outer cover is at least 0.090 inch (2.286 cm). In the golf ball, the core hardness is not optimized, and rebound characteristics and durability are not sufficiently obtained.

In Japanese Patent Kokai Publication No. 10358/1997, a three-piece solid golf ball of which an intermediate layer is placed between a center core and a cover is described. The intermediate layer has a Shore D hardness of 30 to 55, and the cover has a Shore D hardness of 45 to 58. In the golf ball, the core hardness is not optimized and the intermediate layer is mainly formed from thermoplastic elastomer, and rebound characteristics are not sufficiently obtained.

In Japanese Patent Kokai Publication No. 313643/1997, a three-piece solid golf ball of which an intermediate layer is placed between a core and a cover is described. The core has a center hardness in JIS-C hardness of not more than 75 and has a surface hardness in JIS-C hardness of not more than 85, the surface hardness is higher than the center hardness by 5 to 25, a hardness of the intermediate layer is higher than the surface hardness of the core by less than 10, and a hardness of the cover is higher than the hardness of the intermediate layer. In the golf ball, the hardness difference of the core is large, and rebound characteristics and durability are not sufficiently obtained.

In Japanese Patent Kokai Publication No. 305114/1998, a golf ball of which an intermediate layer is placed between a solid core and a cover, of which the surface of the cover has many dimples, is described. The core has a surface hardness in Shore D hardness of not more than 48, the intermediate layer has a hardness in Shore D hardness of 53 to 60 and the hardness of the intermediate layer is higher than the surface hardness of the core by not less than 8, the cover has a hardness in Shore D hardness of 55 to 65 and the hardness of the cover is higher than that of the intermediate layer, the dimples are consisted of two types having different diameter and/or depth from each other, the total number of the dimples is within the range of 370 to 450, the dimples cover at least 63% of the ball surface, and the index $D_{st}$ of the overall dimple surface area is at least 4. In the golf ball, the hardness of the intermediate layer is high, and good shot feel is not sufficiently obtained.

In Japanese Patent Kokai Publication No. 114094/1999, a multi-piece solid golf ball which comprises a solid core, and a two-layer structured cover composed of an inner cover and outer cover, is described. The solid core has a deformation amount of 3 to 7 mm when applying a load of 100 kg, the inner cover has a Shore D hardness of 25 to 58 and a thickness of 0.5 to 1.4 mm, the outer cover has a Shore D hardness of 30 to 62 and a thickness of 1.2 to 2.3 mm, and a ratio of the thickness of the outer cover to that of the inner cover is within the range of 1.1 to 4.6. In the golf ball, the solid core hardness is not optimized, and rebound characteristics and durability are not sufficiently obtained.

In Japanese Patent No. 2570587, a multi-piece solid golf ball which comprises a multi-layer structured solid core composed of an inner core and at least one layer of outer core, and a cover is described. The outer core has a Shore D hardness of 30 to 50 and is mainly formed from a mixture of 100 to 50% by weight of polyether ester type thermoplastic elastomer having a glass transition temperature of not more than −25° C. as determined by differential thermal analysis (DSC); and 0 to 50% by weight of ethylene-(meth)acrylate copolymer ionomer having a flexural modulus of 200 to 400 MPa; and the cover is formed from ethylene-(meth)acrylate copolymer ionomer having a flexural modulus of 200 to 450 MPa and a Shore D hardness of 55 to 68. In the golf ball, the inner core hardness is not optimized, and rebound characteristics and durability are not sufficiently obtained. In addition, rebound characteristics of the outer core (intermediate layer) are not sufficiently obtained.

In Japanese Patent No. 2658811, a three-piece solid golf ball of which an intermediate layer is placed between a center core and a cover is described. The center core has a diameter of not less than 26 mm, a specific gravity of less than 1.4 and a JIS-C hardness of not more than 80, the intermediate layer has a thickness of not less than 1 mm, a specific gravity of less than 1.2 and a JIS-C hardness of less than 80, and the cover has a thickness of 1 to 3 mm and a JIS-C hardness of not less than 85. In the golf ball, the center core hardness is not optimized, and rebound characteristics and durability are not sufficiently obtained. In addition, rebound characteristics of the intermediate layer are not sufficiently obtained.

In the golf balls described above, sufficient performances has not been obtained in view of the balance of the flight performance and shot feel, and durability at a level of practical use, as described above. Therefore, a golf ball, of which the shot feel, flight performance, and durability are further improved, has been required.

OBJECTS OF THE INVENTION

A main object of the present invention is to provide a multi-piece solid golf ball, of which flight performance and shot feel at the time of hitting are improved while maintaining excellent durability.

According to the present invention, the object described above has been accomplished by adjusting a hardness distribution of the core, a hardness of the inner cover and hardness distribution between each layer in the golf ball and the contiguous layer to specified ranges, thereby providing a multi-piece solid golf ball, of which flight performance and shot feel at the time of hitting are improved while maintaining excellent durability.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising a core having at least one layer, an inner cover formed on the core and an outer cover formed on the inner cover, of which the outer cover has many dimples on the surface thereof, wherein

- a surface hardness in JIS-C hardness of the core is higher than a center hardness in JIS-C hardness of the core by less than 5,
- the inner cover has a hardness in Shore D hardness of less than 53 and the hardness of the inner cover is higher than the surface hardness of the core, and
- a hardness of the outer cover is higher than that of the inner cover.

In order to put the present invention into a more suitable practical application,

- it is desired for the core to have a deformation amount of 3.0 to 5.0 mm, when applying from an initial Load of 98 N to a final load of 1274 N;
- it is desired that a hardness difference between the outer cover and inner cover is larger than 6;
- it is desired that a base resin of the inner cover mainly comprise isonomer resin;
- it is desired that the inner cover comprise 5 to 45 parts by weight of thermoplastic elastomer, based on 100 parts by weight of the base resin; and
- it is desired for the golf ball to have two or more types of dimple having different diameter, total number of the dimples of 380 to 500, and total volume of the dimples of 260 to 400 $mm^3$.

DETAILED DESCRIPTION OF THE INVENTION

Figure 1:
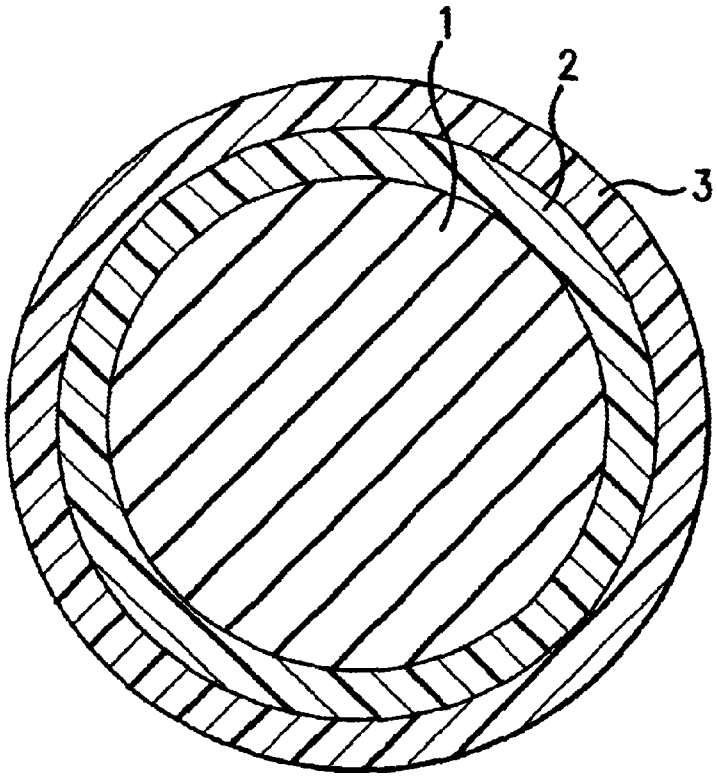
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 1 having at least one layer, an inner cover 2 formed on the core and an outer cover 3 formed on the inner cover. In order to explain the golf ball of the present invention simply, a golf ball having single-layer structured core 1, i.e. three-piece solid golf ball, will be used hereinafter for explanation. However, the golf ball of the present invention may be applied for the golf ball having two or more layers of core.

The core 1 is obtained by press-molding a rubber composition under applied heat by using a method and condition, which has been conventionally used for preparing solid cores of golf balls. The rubber composition contains polybutadiene, an organic sulfide compound, a co-crosslinking agent, an organic peroxide, and optionally a filler, an antioxidant and the like.

The polybutadiene used in the present invention may be one, which has been conventionally used for cores of solid golf balls. Preferred is so-called high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

Examples of organic sulfide compounds include thiophenols, such as pentachlorothiophenol, pentafluorothiophenol, 4-chlorothiophenol, 3-chlorothiophenol, 4-bromothiophenol, 3-bromothiophenol, 4-fluorothiophenol, 4-t-butyl-o-thiophenol, 4-t-butylthiophenol, 2,3-dichlorothiophenol, 2,4-dichlorothiophenol, 2,5-dichlorothiophenol, 2,6-dichlorothiophenol, 3,4-dichlorothiophenol, 3,5-dichlorothiophenol, 2,4,5-trichlorothiophenol, thiosalicylic acid, methylthiosalicylic acid, o-toluenethiol, m-toluenethiol, p-toluenethiol, 3-aminothiophenol, 4-aminothiophenol, 3-methoxythiophenol, 4-methoxythiophenol, 4-mercaptphenyl sulfide, 2-benzamidothiophenol and the like; thiocarboxylic acids, such as thioacetic acid, thiobenzoic acid and the like; disulfides, such as diphenyl disulfide, bis(2-aminophenyl) disulfide, bis(4-aminophenyl) disulfide, bis(4-hydroxyphenyl) disulfide, bis(4-methylphenyl) disulfide, bis(4-t-butylphenyl) disulfide, bis(2-benzamidophenyl) disulfide, dixylyl disulfide, di(o-benzamidophenyl) disulfide, dimorpholino disulfide, bis(4-chlorophenyl) disulfide, bis(3-chlorophenyl) disulfide, bis(2-chlorophenyl) disulfide, bis(4-bromophenyl) disulfide, bis(3-bromophenyl) disulfide, bis(2-bromophenyl) disulfide, bis(2,5-dichlorophenyl) disulfide, bis(3,5-dichlorophenyl) disulfide, bis(2,4,5-trichlorophenyl) disulfide, bis(2-cyanophenyl) disulfide, bis(2-nitrophenyl) disulfide, bis(4-nitrophenyl) disulfide, bis(2,4-dinitrophenyl) disulfide, 2,2-dithiodibenzoic acid, 5,5-dithiobis(2-nitrobenzoic acid), bis (pentafluorophenyl) disulfide, dibenzyl disulfide, di-t-dodecyl disulfide, diallyl disulfide, difurfuryl disulfide, 2,2'-dibenzothiazoryl disulfide, bis(2-naphthyl) disulfide, bis(4-mercaptphenyl) disulfide, 4-(2-benzothiazoryldithio) morpholine, 2,2-dipyridinyl disulfide, 2,2-dithiobis(5-nitropyridine), 2,2-dithiodianiline, 4,4-dithiodianiline, dithiodiglycolic acid, 4,4'-dithiodimorpholine, L-cystine and the like; thiurams, such as tetramethylthiuram disulfide, tetraethylthiuram disulfide, tetrabutylthiuram disulfide, tetramethylthiuram monosulfide, N,N'-dimethyl-N,N'-diphenylthiuram disulfide, dipentamethylenethiuram tetrasulfide and the like; thiazoles, such as 2-mercaptbenzothiazole, 2-mercaptbenzothiazole sodium salt, 2-mercaptbenzothiazole zinc salt, 2-mercaptbenzothiazole dicyclohexylamine salt, 2-(N,N-diethylcarbamylthio)benzothiazole, 2-(4'-morphorinodithio) benzothiazole, 2,5-dimercapt-1,3,4-thiadiazole, Bismuthiol I, Bismuthiol II, 2-amino-5-mercapt-1,3,4-thiadiazole, trithiocyanuric acid and the like; sulfenamides; thioureas; dithiocarbamates; and mixtures thereof. Preferred are thiophenols, disulfides and the like, in view of the technical effects of improving rebound characteristics and its cheapness. The amount of the organic sulfide compound is preferably from 0.2 to 3.0 parts by weight, more preferably 0.4 to 2.0 parts by weight, based on 100 parts by weight of the polybutadiene. When the amount of the organic sulfide compound is smaller than 0.2 parts by weight, the technical effects accomplished by using the organic sulfide compound as a additive are sufficiently obtained. On the other hand, when the amount is larger than 3.0 parts by weight, the organic sulfide compound is excessive, and performances of the resulting golf ball are reversely degraded.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is preferably from 0.3 to 2.0 parts by weight, more preferably 0.3 to 1.5 parts by weight, based on 100 parts by weight of the polybutadiene. When the amount of the organic peroxide is smaller than 0.3 parts by weight, the vulcanization reaction in the core is not sufficiently conducted. On the other hand, when the amount of the organic peroxide is larger than 2.0 parts by weight, the core is comparatively hard, but the rebound characteristics are not improved, or the shot feel is poor.

Examples of the co-crosslinking agents include α,β-unsaturated carboxylic acids having 3 to 8 carbon atoms (e.g. acrylic acid, methacrylic acid, etc.), a mono- or divalent metal salt such as the zinc or magnesium salt thereof and mixtures thereof. The preferred co-crosslinking agent is zinc acrylate because it imparts high rebound characteristics to the resulting golf ball. The amount of the co-crosslinking agent is preferably from 15 to 30 parts by weight, more preferably from 20 to 28 parts by weight, based on 100 parts by weight of the polybutadiene. When the amount of the co-crosslinking agent is smaller than 15 parts by weight, the vulcanization reaction in the core is not sufficiently conducted, and the rebound characteristics and durability are greatly degraded. On the other hand, when the amount of the co-crosslinking agent is larger than 30 parts by weight, the resulting golf ball is too hard, and the shot feel is poor.

Where appropriate, it is possible to compound a component which is typically used in the manufacture of solid golf ball cores together with the rubber composition; e.g., fillers such as zinc oxide, barium sulfate, calcium carbonate and the like, and other additives such as antioxidants, peptizing agents and the like. If used, preferably the amount of the filler is 5 to 30 parts by weight, the amount of the antioxidant is 0.2 to 5 parts by weight, based on 100 parts by weight of the polybutadiene.

The core 1 used for the golf ball of the present invention can be obtained by mixing and then press-molding the above rubber composition under applied heat of 130 to 180° C. and 2.9 to 9.8 MPa for 10 to 50 minutes in a mold.

In the golf ball of the present invention, the core 1 has a diameter of 30 to 40 mm, preferably 33 to 39 mm. When the diameter of the core is smaller than 30 mm, the thickness of the inner cover and that of the outer cover are large and the technical effects accomplished by the presence of the core are not sufficiently obtained, which degrades rebound characteristics and shot feel. On the other hand, when the diameter is larger than 40 mm, the thickness of the inner cover and that of the outer cover are small, and the technical effects of impact absorption accomplished by the presence of the inner cover or outer cover are not sufficiently obtained, which degrades shot feel and durability.

In the golf ball of the present invention, it is required for the core 1 to have a surface hardness higher than a center hardness in JIS-C hardness by less than 5, preferably not more than 4. When the hardness difference is not less than 5, the hardness difference in the core is large, and the core excessively deforms as compared with the cover. Therefore, energy loss is large, which degrades flight distance and durability.

In the golf ball of the present invention, it is desired for the core 1 to have the surface hardness in JIS-C hardness of 50 to 90, preferably 60 to 85, more preferably 65 to 80. When the hardness is lower than 50, the core is too soft, and the rebound characteristics of the resulting golf ball are degraded, which reduces the flight distance. On the other hand, when the hardness is higher than 90, the core is too hard, and the shot feel is poor. The term "a surface hardness of the core" as used herein refers to the hardness, which is determined by measuring a hardness at the surface of the resulting core.

In the golf ball of the present invention, it is desired for the core 1 to have the center hardness in JIS-C hardness of 45 to 85, preferably 55 to 80, more preferably 60 to 75. When the center hardness is lower than 45, the core is too soft, and rebound characteristics are degraded. On the other hand, when the center hardness is higher than 85, the core is too hard, and the shot feel is poor. The term "a center hardness of the core" as used herein refers to the hardness, which is determined by cutting the resulting core into two equal parts and then measuring a hardness at its center point in section.

In the golf ball of the present invention, it is desired for the core 1 to have a deformation amount when applying from an initial load of 98 N to a final load of 1274 N of 3.0 to 5.0 mm, preferably 3.5 to 5.0 mm, more preferably 3.5 to 4.5 mm. When the deformation amount of the core is smaller than 3.0 mm, the core is too hard, and it is difficult to deform at the time of hitting, which degrades the shot feel of the resulting golf ball. On the other hand, when the deformation amount is larger than 5.0 mm, the core is too soft and excessively deforms at the time of hitting, and durability of the resulting golf ball are degraded. The inner cover 2 is then formed on the core 1.

The inner cover 2 of the golf ball of the present invention, which is not limited, may be formed from ionomer resins or thermoplastic elastomers, or mixtures thereof, as a base resin. Examples of the ionomer resins include a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like. Preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. Examples of the metal ion which neutralizes a portion of carboxylic acid groups of the copolymer or terpolymer include a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1702, Hi-milan 1705, Hi-milan 1706, Hi-milan 1707, Hi-milan 1855 and the like. Examples of the ionomer resins, which are commercially available from Du Pont Co., include Surlyn 8945, Surlyn 9945, Surlyn 6320, Surlyn 8320, Surlyn 9320 and the like. Examples of the ionomer resins, which are commercially available from Exxon Chemical Co., include Iotek 7010, Iotek 8000 and the like. These ionomer resins may be used alone or in combination.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based thermoplastic elastomer, which is commercially available from Takeda Badische Urethane Industries, Ltd. under the trade name of "Elastollan" (such as "Elastollan ET880"); polyurethane-based thermoplastic elastomer, which is commercially available from Dainippon Ink & Chemicals Inc., Ltd. under the trade name of "Pandex" (such as "Pandex T-8180"); styrene-based thermoplastic elastomer, which is commercially available from Mitsubishi Chemical Co., Ltd. under the trade name of "Rabalon" (such as "Rabalon SR04"); and the like. Preferred are polyurethane-based thermoplastic elastomer and styrene-based thermoplastic elastomer.

In the golf ball of the present invention, it is desired that a base resin of the inner cover 2 mainly comprise ionomer resin, and comprise at least one thermoplastic elastomer in an amount of 5 to 45 parts by weight, preferably 20 to 45 parts by weight, more preferably 30 to 40 parts by weight, based on 100 parts by weight of the base resin for the inner cover. When the amount of the thermoplastic elastomer is smaller than 5 parts by weight, the inner cover hardness is too high, and the shot feel is poor. On the other hand, when the amount is larger than 45 parts by weight, the inner cover hardness is too low, and the rebound characteristics are degraded, which reduces the flight distance.

The composition for the inner cover 2 used in the present invention may optionally contain fillers, pigments, and the other additives such as an antioxidant, in addition to the ionomer resins or thermoplastic elastomers, or mixtures thereof as main component. Examples of fillers include inorganic filler (such as zinc oxide, barium sulfate, calcium carbonate and the like), high specific gravity metal powder filler (such as tungsten powder, molybdenum powder and the like), and the mixture thereof.

A method of forming the inner cover 2 is not specifically limited, but may be a well-known method, which has been conventionally used for forming golf ball cover. For example, there can be used a method comprising molding the inner cover composition into a semi-spherical half-shell, covering the core with the two half-shells, followed by pressure molding, or a method comprising injection molding the inner cover composition directly on the core to cover it.

In the golf ball of the present invention, it is required for the inner cover 2 to have a hardness in Shore D hardness of less than 53, preferably not less than 35 and less than 53, more preferably 40 to 50. When the inner cover hardness is not less than 53, it is approximately equal to a hardness of the outer cover, and the shot feel is poor. In addition, a hardness difference from the core hardness is large, and deformation in the golf ball is unequal, which degrades the durability.

In the golf ball of the present invention, it is required for the inner cover 2 to have a hardness higher than the surface hardness of the core, and the hardness difference in Shore D hardness is preferably larger than 3. When the inner cover hardness is not more than the surface hardness of the core, rebound characteristics are degraded, which reduces the flight distance.

In the golf ball of the present invention, it is desired for the inner cover 2 to have a thickness of 0.5 to 3.0 mm, preferably 0.8 to 2.5 mm, more preferably 1.0 to 2.0 mm. When the thickness of the inner cover is smaller than 0.5 mm, the inner cover is too thin, and the technical effects accomplished by the presence of the inner cover are not sufficiently obtained, which degrades flight performance and durability of the resulting golf ball. On the other hand, when the thickness of the inner cover is larger than 3.0 mm, the technical effects accomplished by the presence of the core are not sufficiently obtained, which degrades flight performance and shot feel of the resulting golf ball. The outer cover 3 is then formed on the inner cover 2.

In the outer cover 3 of the golf ball of the present invention, the same materials as described above for the material used in the inner cover 2, which are ionomer resins, thermoplastic resins, or mixtures thereof, can be used. As suitable materials used in the outer cover 3 of the present invention, the above ionomer resin may be used alone, but the ionomer resin may be suitably used in combination with at least one of the same thermoplastic elastomers used in the inner cover 2.

The composition for the outer cover 3 used in the present invention may optionally contain fillers (such as barium sulfate), pigments (such as titanium dioxide, etc.) and the other additives such as a dispersant, an antioxidant, a UV absorber, a photostabilizer and a fluorescent agent or a fluorescent brightener, etc., in addition to the base resin as a main component, as long as the addition of the additives does not deteriorate the desired performance of the golf ball cover. If used, preferably the amount of the pigment is 0.1 to 5.0 parts by weight, based on 100 parts by weight of the base resin for the cover.

A method of covering the inner cover 2 with the outer cover 3 is not specifically limited, but may be the same method as used in the inner cover 2. In the golf ball of the present invention, it is desired for the outer cover 3 to have a thickness of 0.5 to 3.0 mm, preferably 0.8 to 2.5 mm, more preferably 1.0 to 2.0 mm. When the thickness of the outer cover is smaller than 0.5 mm, the outer cover is too thin, and the technical effects accomplished by the presence of the outer cover are not sufficiently obtained, which degrades flight performance and durability of the resulting golf ball. On the other hand, when the thickness is larger than 3.0 mm, the technical effects accomplished by the presence of the core and inner cover are not sufficiently obtained, which degrades shot feel of the resulting golf ball.

In the golf ball of the present invention, it is required for the outer cover to have a hardness higher than that of the inner cover, and the hardness difference between the outer cover and inner cover is preferably higher than 6, more preferably not less than 8, most preferably not less than 10. When the hardness of the outer cover is not more than that of the inner cover, rebound characteristics are degraded, which reduces flight distance.

In the golf ball of the present invention, it is desired for the outer cover 3 to have a hardness in Shore D hardness of not less than 55, preferably 55 to 77, more preferably 58 to 67. When the hardness of the outer cover is lower than 55, deformation at the surface of the resulting golf ball at the time of hitting is large even if adjusting the core hardness, and the rebound characteristics of are degraded. In addition, the shot feel is heavy and poor. The terms "hardness of the inner cover" and "hardness of the outer cover" as used herein are determined by measuring a hardness, using a sample of a stack of the three or more heat and press molded sheets having a thickness of 2 mm from the composition for each cover, which had been stored at 23° C. for 2 weeks.

At the time of molding the outer cover, many depressions called "dimples" may be optionally formed on the surface of the golf ball. It is desired for the dimples to be of not less than 2 types, preferably 2 to 5 types, which have different diameter. When the dimples are of one type, that is, the dimples have all the same diameter, it is difficult to disturb an airflow around the golf ball on the fly, which degrades its flight performance.

It is desired for the dimple to have a diameter of 2 to 5 mm, preferably 2.3 to 4.8 mm. When the diameter of the dimple is smaller than 2 mm, an area of an opening of the dimple is too small, and the technical effects accomplished by the presence of the dimple are not sufficiently obtained. On the other hand, when the diameter of the dimple is larger than 5 mm, a number of the dimple arranged on the surface of the golf ball is small, and the technical effects accomplished by the presence of the dimple are not sufficiently obtained.

It is desired for the dimple to have a total number of 380 to 500, preferably 390 to 480, more preferably 390 to 470. When the total number of the dimples is smaller than 380, the resulting golf ball creates blown-up trajectory, which reduces flight distance. On the other hand, when the total number of the dimples is larger than 500, the trajectory of the resulting golf ball is easy to drop, which reduces the flight distance.

It is desired for the dimples to have a total volume of 260 to 400 $mm^3$, 270 to 370 $mm^3$, 280 to 350 $mm^3$. When the total volume of the dimple is smaller than 260 $mm^3$, the resulting golf ball creates blown-up trajectory, which reduces flight distance. On the other hand, when the total volume of the dimples is larger than 400 $mm^3$, the trajectory of the resulting golf ball is easy to drop, which reduces the flight distance. The diameter of the dimple and total volume of the dimples as used herein are determined by measuring at the surface of the golf ball, and if paint is applied on the outer cover, they are determined by measuring at the surface of the applied golf ball. The total volume of the dimples is the sum of a volume of a space enclosed by a concave of the dimple and a plane passed through an edge of the dimple.

Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

Production of Core

The rubber compositions for the core having the formulation shown in Table 1 were mixed by using a mixing roll, and the mixtures were then press molded at the vulcanization condition shown in Table 4 (Examples) and Table 5 (Comparative Examples) in a mold to obtain cores having a diameter 35.2 mm. The center hardness (a), surface hardness (b) and deformation amount of the resulting core were measured, and the results are shown in the same Tables. As the surface hardness, the surface hardness in JIS-C hardness ($b_C$) and the surface hardness in Shore D hardness ($b_D$) were measured. The hardness difference ($b_C$−a) was determined by calculating from the above values of ($b_C$) and (a), and the results are shown in the same Tables. The test methods are described later.

TABLE 1

| Core composition | (parts by weight) I | II | III |
|---|---|---|---|
| BR-11 *1 | 100 | 100 | 100 |
| Zinc acrylate | 27 | 29 | 20 |
| Zinc oxide | 30.5 | 30 | 32.5 |
| Dicumyl peroxide | 0.8 | 0.8 | 0.8 |
| Diphenyl disulfide | 0.5 | 0.5 | 0.5 |

*1: High-cis polybutadiene (trade name "BR-11") available from JSR Co., Ltd. (Content of 1,4-cis-polybutadiene: 96%)

Preparation of Compositions for Inner Cover and Outer Cover

The formulation materials for the inner cover showed in Table 2 and formulation materials for the outer cover showed in Table 3 were respectively mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder. The hardness of the inner cover (c) and the hardness of the outer cover (d) were determined by measuring a hardness, using a sample of a stack of the three or more heat and press molded sheets having a thickness of 2 mm from the composition for each cover, which had been stored at 23° C. for 2 weeks, with a Shore D hardness meter according to ASTM D-2240. The results are shown in Tables 2 and 3, and Table 4 (Examples) and Table 5 (Comparative Examples), respectively. The hardness differences (c−$b_D$) and (d−c) were determined by calculating from the above values of ($b_D$), (c) and (d), and the results are shown in Table 4 (Examples) and Table 5 (Comparative Examples).

TABLE 2

| Inner cover composition | | (parts by weight) A | B | C | D |
|---|---|---|---|---|---|
| Hi-milan 1605 | *2 | 35 | 30 | 35 | 10 |
| Hi-milan 1706 | *3 | 30 | 30 | 35 | — |
| Hi-milan AM7316 | *4 | — | — | 30 | — |
| Hytrel 3548 | *5 | 35 | — | — | — |
| Elastollan ET880 | *6 | — | — | — | 90 |
| Rabalon SR04 | *7 | — | 40 | — | — |
| Shore D hardness | | 50 | 49 | 57 | 35 |

TABLE 3

| Outer cover composition | | (parts by weight) X | Y |
|---|---|---|---|
| Hi-milan 1605 | *2 | 50 | 25 |
| Hi-milan 1706 | *3 | 50 | 25 |
| Hi-milan 1855 | *8 | — | 50 |
| Titanium dioxide | | 2 | 2 |

TABLE 3-continued

| Outer cover composition | (parts by weight) X | Y |
|---|---|---|
| Barium sulfate | 2 | 2 |
| Shore D hardness | 63 | 58 |

*2: Hi-milan 1605 (trade name), ethylene-methacrylic acid copolymer ionomer resin obtained by neutralizing with sodium ion, manufactured by Mitsui Du Pont Polychemical Co., Ltd.
*3: Hi-milan 1706 (trade name), ethylene-methacrylic acid copolymer ionomer resin obtained by neutralizing with zinc ion, manufactured by Mitsui Du Pont Polychemical Co., Ltd.
*4: Hi-milan AM7316 (trade name), ethylene-methacrylic acid-acrylate terpolymer ionomer resin obtained by neutralizing with zinc ion, manufactured by Mitsui Du Pont Polychemical Co., Ltd.
*5: Hytrel 3548 (trade name), polyester-based thermoplastic elastomer, which is commercially available from Toray-Do Pont Co., Ltd.
*6: Elastollan ET880 (trade name), polyurethane-based thermoplastic elastomer commercially available from Takeda Badische Urethane Industries, Ltd.
*7: Rabalon SR04 (trade name), styrene-based thermoplastic elastomer, manufactured by Mitsubishi Chemical Co., Ltd.
*8: Hi-milan 1855 (trade name), ethylene-methacrylic acid-acrylate terpolymer ionomer resin obtained by neutralizing with zinc ion, manufactured by Mitsui Du Pont Polychemical Co., Ltd.

Formation of Inner Cover

The resulting composition for the inner cover was injection-molded on the core to form an inner cover having a thickness of 1.8 mm.

Examples 1 to 5 and Comparative Examples 1 to 3 The resulting composition for the outer cover was covered on the inner cover by injection molding using a mold having dimples for golf ball to form an outer cover layer having a thickness of 2.0 mm. Then, paint was applied on the surface to obtain golf ball having a diameter of 42.8 mm. The total number of the dimples, total volume of the dimples, hardness, coefficient of restitution, flight distance, durability and shot feel of the resulting golf balls were measured or evaluated. The results are shown in Table 4 (Examples) and Table 5 (Comparative Examples). The test methods are as follows.

(Test Method)

(1) Hardness (i) Core Hardness

The surface hardness of the core is determined by measuring JIS-C hardness at the surface of the core. The center hardness of the core is determined by measuring JIS-C hardness at the center point of the core in section, after the core is cut into two equal parts. The JIS-C hardness was measured with a JIS-C hardness meter according to JIS K 6301. As the surface hardness, the surface hardness in Shore D hardness was also measured. The Shore D hardness was measured with a Shore D hardness meter according to ASTM D-2240.

(ii) Inner Cover and Outer Cover Hardness

The hardness of the inner cover or outer cover was determined by measuring a hardness, using a sample of a stack of the three or more heat and press molded sheets having a thickness of about 2 mm from each cover composition, which had been stored at 23° C. for 2 weeks, with a Shore D hardness meter according to ASTM D-2240.

(2) Deformation Amount

The deformation amount of core was determined by measuring a deformation amount when applying from an initial load of 98 N to a final load of 1274 N on the core.

(3) Total Volume of the Dimple

With respect to "m" types of dimples on the surface of the golf ball, a dimple shape in section is measured using a pick-up type (contact type) of profile meter, and the volumes of each type of dimple, $v_1$ to $v_m$ are obtained by calculating from the shape. The total volume of dimples B determined by calculating from the volumes ($v_1$ to $v_m$) and the numbers ($n_1$ to $n_m$) of each type of dimple, according to the following formula:

$$V=v_1n_1+v_2n_2+\ldots+v_mn_m$$

If the golf ball has two types of dimples (m=2), the total volume of dimples V is represented by the following formula:

$$V=v_1n_1+v_2n_2$$

Figure 2:
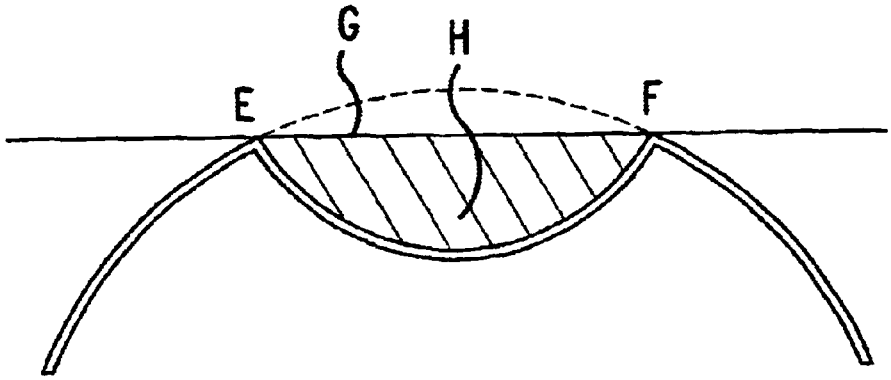
FIG. 2 is a schematic cross section of a dimple of the golf ball of the present invention using for explaining the method of measuring a total volume of the dimples.

The volume of each dimple is determined by tracing the bottom portion of the dimple measured, forming a chart from one edge E to other edge F of the dimple as described in FIG. 2, plotting each point from E to F from the chart, drawing a tangent line G through the points E and F as described in FIG. 1, and calculating the volume of the portion H, which is enclosed by the tangent line G and the bottom of the dimple.

(4) Coefficient of Restitution

A cylindrical aluminum projectile having weight of 200 g was struck at a speed of 40 m/sec against a golf ball, and the velocity of the projectile and the golf ball before and after the strike were measured. The coefficient of restitution of the golf ball was calculated from the velocity and the weight of both the projectile and the golf ball. The measurement was conducted by using 12 golf balls for each sample (n=12), with the mean value being taken as the coefficient of restitution of each ball and expressed as an index, with the value of the index in Comparative Example 1 being taken as 1. A higher index corresponded to a higher rebound characteristic, and thus a good result.

(5) Flight Distance

A No. 1 wood club (W#1, a driver) having metal head was mounted to a swing robot manufactured by True Temper Co. and the resulting golf ball was hit at a head speed of 40 m/sec, the flight distance was measured. As the flight distance, carry that is a distance to the dropping point of the hit golf ball was measured. The measurement was conducted by using 12 golf balls for every sample (n=12), and the average is shown as the result of the golf ball.

(6) Durability

A No.1 wood club (W#1, a driver) having metal head was mounted to a swing robot manufactured by True Temper Co. and the resulting golf ball was hit at a head speed of 45 m/second to strike against an impact board, repeatedly. The durability is determined by measuring the number of hit until the cover of the golf ball cracks, and is expressed as an index, with the value of the index in Comparative Example 1 being taken as 100. The larger the value is, the better durability the golf ball has.

(7) Shot Feel

The shot feel of the resulting golf ball was evaluated by 10 golfers according to practical hitting test using a No. 1 wood club (W#1, a driver) having metal head. The evaluation criteria are as follows.

(Evaluation Criteria)

oo: Not less than 8 golfers out of 10 golfers felt that the golf ball has good shot feel such that the impact force at the time of hitting is low and the rebound characteristics is good.

o: Six to 7 golfers out of 10 golfers felt that the golf ball has good shot feel such that the impact force at the time of hitting is low and the rebound characteristics is good.

Δ: Four to 5 golfers out of 10 golfers felt that the golf ball has good shot feel such that the impact force at the time of hitting is low and the rebound characteristics is good.

x: Not more than 3 golfers out of 10 golfers felt that the golf ball has good shot feel such that the impact force at the time of hitting is low and the rebound characteristics is good.

TABLE 4

| Test item | | Example No. 1 | 2 | 3 | 4 | 5 |
|---|---|---|---|---|---|---|
| (Core) | | | | | | |
| Composition | | I | II | I | III | II |
| Vulcanization condition | | | | | | |
| The first stage | Temp. (° C.) | 144 | 144 | 144 | 144 | 144 |
| | Time (min) | 25 | 25 | 25 | 25 | 25 |
| The second stage | Temp. (° C.) | 165 | 165 | 165 | 165 | 165 |
| | Time (min) | 8 | 8 | 8 | 8 | 8 |
| Center hardness (a) (JIS - C) | | 71 | 72 | 71 | 62 | 72 |
| Surface hardness $b_C$ (JIS-C) | | 74 | 76 | 74 | 65 | 76 |
| Surface hardness $b_D$ (Shore D) | | 44 | 46 | 44 | 38 | 46 |
| Hardness difference ($b_C$–a) | | 3 | 4 | 3 | 3 | 4 |
| Deformation amount (mm) | | 4.3 | 4.0 | 4.3 | 5.1 | 4.0 |
| (Inner cover) | | | | | | |
| Composition | | A | A | B | A | A |
| Hardness (c) (Shore D) | | 50 | 50 | 49 | 50 | 50 |
| Hardness difference (c–$b_D$) | | 6 | 4 | 5 | 12 | 4 |
| (Outer cover) | | | | | | |
| Composition | | X | Y | X | X | X |
| Hardness (d) (Shore D) | | 63 | 58 | 63 | 63 | 63 |
| Hardness difference (d–c) | | 13 | 8 | 14 | 13 | 13 |
| Total dimple number | | 432 | 432 | 390 | 360 | 360 |
| Total dimple volume ($mm^3$) | | 310 | 310 | 320 | 280 | 280 |
| Physical properties of golf ball | | | | | | |
| Coefficient of restitution | | 1.02 | 1.01 | 1.01 | 0.99 | 1.02 |
| Flight distance (m) | | 192.5 | 192 | 192 | 191 | 192 |
| Durability | | 110 | 120 | 115 | 105 | 115 |
| Shot feel | | ○○ | ○○ | ○○ | ○ | ○ |

TABLE 5

| Test item | | Comparative Example No. 1 | 2 | 3 |
|---|---|---|---|---|
| (Core) | | | | |
| Composition | | II | I | II |
| Vulcanization condition | | | | |
| The first stage | Temp. (° C.) | 155 | 144 | 144 |
| | Time (min) | 25 | 25 | 25 |
| The second stage | Temp. (° C.) | — | 165 | 165 |
| | Time (min) | — | 8 | 8 |
| Center hardness (a) (JIS-C) | | 65 | 71 | 72 |
| Surface hardness $b_C$ (JIS-C) | | 80 | 74 | 76 |
| Surface hardness $b_D$ (Shore D) | | 51 | 44 | 46 |
| Hardness difference ($b_c$-a) | | 15 | 3 | 4 |
| Deformation amount (mm) | | 4.2 | 4.3 | 4.0 |
| (Inner cover) | | | | |
| Composition | | A | C | D |
| Hardness (c) (Shore D) | | 50 | 57 | 35 |
| Hardness difference (c-$b_D$) | | −1 | 13 | −11 |
| (Outer cover) | | | | |
| Composition | | X | Y | X |
| Hardness (d) (Shore D) | | 63 | 58 | 63 |
| Hardness difference (d-c) | | 13 | 1 | 28 |
| Total dimple number | | 432 | 432 | 410 |
| Total dimple volume ($mm^3$) | | 310 | 310 | 300 |
| Physical properties of golf ball | | | | |
| Coefficient of restitution | | 1 | 0.98 | 0.99 |
| Flight distance (m) | | 190 | 189.5 | 190 |

TABLE 5-continued

| Test item | Comparative Example No. 1 | 2 | 3 |
|---|---|---|---|
| Durability | 100 | 98 | 108 |
| Shot feel | Δ | X | Δ |

As is apparent from Tables 4 and 5, the golf balls of Examples 1 to 5 of the present invention, when compared with the golf balls of Comparative Examples 1 to 3, had excellent flight performance and good shot feel, while maintaining excellent durability.

On the other hand, in the golf ball of Comparative Example 1, since the hardness difference ($b_c$–a) between the surface hardness ($b_c$) and center hardness (a) of the core is large, the core deforms too largely, when compared with the cover, and energy loss is large. Therefore, the flight distance is short and the durability is poor. In addition, the hardness of the inner core is not more than the surface hardness of the core, and the rebound characteristics are degraded, which reduces the flight distance.

In the golf ball of Comparative Example 2, since the hardness of the inner cover is high, it is approximately equal to the hardness of the outer cover, and the shot feel is very poor. In addition, a hardness difference from the core hardness is large, and deformation in the golf ball is unequal, which degrades the durability.

In the golf ball of Comparative Example 3, since the hardness of the inner cover is not more than the surface hardness of the core, and the rebound characteristics are degraded, which reduces the flight distance.

What is claimed is:

1. A multi-piece solid golf ball comprising a core having at least one layer, an inner cover formed on the core and an outer cover formed on the inner cover, of which the outer cover has many dimples on the surface thereof, wherein a surface hardness in JIS-C hardness of the core is higher than a center hardness in JIS-C hardness of the core by less than 5, the inner cover has a hardness in Shore D hardness of less than 53 and the hardness of the inner cover is higher than the surface hardness of the core, and a hardness of the outer cover is higher that that of the inner cover, wherein the core has a deformation amount of 3.0 to 5.0 mm, when applying from an initial load of 98 N to a final load of 1274 N, wherein the golf ball has a total volume of the dimples of 260 to 400 $mm^3$, and wherein the inner cover comprises 5 to 45 parts by weight of thermoplastic elastomer, based on 100 parts by weight of the base resin.

2. The multi-piece solid golf ball according to claim 1, wherein a hardness difference in Shore D hardness between the outer cover and inner cover is larger than 6.

3. The multi-piece solid golf ball according to claim 1, wherein a base resin of the inner cover mainly comprises ionomer resin.

4. The multi-piece solid golf ball according to claim 1, wherein the golf ball has two or more types of dimples having different diameters.

5. The multi-piece solid golf ball according to claim 1, wherein assuming that the surface hardness of the core in Shore D hardness is represented by "$b_D$" and the hardness of the inner cover in Shore D hardness is represented by "c", a hardness difference ($c-b_D$) is not less than 4 and not more than 12.

6. The multi-piece solid golf ball according to claim 1, wherein the core is prepared from a rubber composition comprising polybutadiene rubber containing a molar percentage of cis-1,4 bond of not less than 40%.

7. The multi-piece solid golf ball according to claim 1, wherein the core comprises a rubber composition prepared with an organic peroxide which is at least one selected from the group consisting of dicumyl peroxide, 1, 1-bis (t-butylperoxy)-3,3,5-trimethylcyclohexane, 2, 5-dimethyl-2, 5-di (t-butylperoxy) hexane and di-t-butyl peroxide.

8. The multi-piece solid golf ball according to claim 1, wherein the core comprises a rubber composition prepared with a co-crosslinking agent which is at least one selected from the group consisting of α,β-unsaturated carboxylic acid having 3 to 8 carbon atoms, a mono- or divalent metal salt thereof and mixtures thereof.

9. The multi-piece solid golf ball according to claim 1, wherein the core has a diameter of 30–40 mm.

10. The multi-piece solid golf ball according to claim 1, wherein the core has a center hardness is JIS-C hardness of 45–85.

11.The multi-piece solid golf ball according to claim 1, wherein the inner cover has a thickness of 0.5 to 3.0 mm.

12. The multi-piece solid golf ball according to claim 1, wherein the outer cover has a thickness of 0.5 to 3.0 mm.

13. The multi-piece solid golf ball according to claim 1, wherein the outer cover has a hardness in Shore D hardness of not less than 55.

14. A multi-piece solid golf ball comprising a core having at least one layer, an inner cover formed on the core and an outer cover formed on the inner cover, of which the outer cover has many dimples on the surface thereof, wherein a surface hardness in JIS-C hardness of the core is higher than a center hardness in JIS-C hardness of the core by less than 5, the inner cover has a hardness in Shore D hardness of less than 53 and the hardness of the inner cover is higher than the surface hardness of the core, and a hardness of the outer cover is higher than that of the inner cover, wherein the core has a deformation amount of 3.0 to 5.0 mm, when applying from an initial load of 98 N to a final load of 1274 N, wherein the golf ball has a total volume of the dimples of 260 to 400 $mm^3$, and wherein that core is made of a rubber composition comprising an organic sulfide compound which is at least one of a thiophenol and a disulfide.

15. The multi-piece solid golf ball according to claim 14, wherein the organic sulfide is added in an amount of 0.2 to 3.0 parts by weight based on 100 parts by weight of the polybutadiene.

16. A multi-piece solid golf ball comprising a core having at least one layer, an inner cover formed on the core and an outer cover formed on the inner cover, of which the outer cover has many dimples on the surface thereof, wherein a surface hardness in JIS-C hardness of the core is higher than a center hardness in JIS-C hardness of the core by less than 5, the inner cover has a hardness in Shore D hardness of less than 53 and the hardness of the inner cover is higher than the surface hardness of the core, and a hardness of the outer cover is higher than that of the inner cover, wherein the core has a deformation amount of 3.0 to 5.0 mm, when applying from an initial load of 98 N to a final load of 1274 N, wherein the golf ball has a total volume of the dimples of 260 to 400 $mm^3$, and wherein the core is made of a rubber composition comprising a polybutadiene and a co-crosslinking agent and the co-crosslinking agent is added in an amount of 15–30 parts by weight based on 100 parts by weight of a polybutadiene.

* * * * *